US005981126A

United States Patent [19]

Majumdar et al.

[11] Patent Number: 5,981,126

[45] Date of Patent: Nov. 9, 1999

[54] CLAY CONTAINING ELECTRICALLY-CONDUCTIVE LAYER FOR IMAGING ELEMENTS

[75] Inventors: Debasis Majumdar, Rochester; Sharon M. Melpolder, Hilton; Charles C. Anderson, Penfield; Paul A. Christian, Pittsford; Thomas N. Blanton, Rochester, all of N.Y.

[73] Assignee: Eastman Kodak Company, Rochester, N.Y.

[21] Appl. No.: 08/940,860

[22] Filed: Sep. 29, 1997

[51] Int. Cl.[6] ..... G03G 5/10

[52] U.S. Cl. ..... 430/63; 430/62

[58] Field of Search ..... 430/63, 62, 96

[56] References Cited

U.S. PATENT DOCUMENTS

| | | | |
|---|---|---|---|
| 3,245,833 | 4/1966 | Trevoy | 117/201 |
| 4,173,480 | 11/1979 | Woodward | 430/536 |
| 4,275,103 | 6/1981 | Tsubusaki et al. | 428/148 |
| 4,393,441 | 7/1983 | Enge | 363/61 |
| 4,416,963 | 11/1983 | Takimoto et al. | 430/69 |
| 4,418,141 | 11/1983 | Kawaguchi et al. | 430/530 |
| 4,431,764 | 2/1984 | Yoshizumi | 524/409 |
| 4,442,168 | 4/1984 | White et al. | 428/331 |
| 4,495,276 | 1/1985 | Takimoto et al. | 430/527 |
| 4,571,361 | 2/1986 | Kawaguchi et al. | 428/329 |
| 4,571,365 | 2/1986 | Ashlock et al. | 428/412 |
| 4,990,276 | 2/1991 | Bishop et al. | 252/62.5 |
| 4,999,276 | 3/1991 | Kuwabara et al. | 430/264 |
| 5,122,445 | 6/1992 | Ishigaki | 430/523 |
| 5,204,219 | 4/1993 | Van Ooij et al. | 430/272 |
| 5,236,818 | 8/1993 | Carlson | 430/527 |
| 5,340,676 | 8/1994 | Anderson et al. | 430/63 |
| 5,368,995 | 11/1994 | Christian et al. | 430/530 |
| 5,554,670 | 9/1996 | Giannelis et al. | 523/209 |

FOREIGN PATENT DOCUMENTS

| | | |
|---|---|---|
| 0 250 154 | 12/1987 | European Pat. Off. . |
| 0 301 827 B1 | 2/1989 | European Pat. Off. . |

OTHER PUBLICATIONS

T. Lan, "Mechanism of Clay Tactoid Exfoliation in Epoxy–Clay Nanocomposites", Chem. Mater, 1995, 7, 2144–2150.
Research Disclosure 38957, Sep. 1996, pp. 591–639.
Research Disclosure 36544, Sep. 1994, pp. 501–541.
Research Disclosure 37038, Feb. 1995, pp. 79–116.

*Primary Examiner*—John Goodrow
*Attorney, Agent, or Firm*—Carl F. Ruoff

[57] ABSTRACT

The present invention is an imaging element which includes a support, an image forming layer superposed on the support, and an electrically conducting layer. The electrically conductive layer includes a smectite clay, a first polymeric binder which sufficiently intercalates inside or exfoliates the smectite clay and a second polymeric binder which does not sufficiently intercalate inside or exfoliate the smectite clay.

10 Claims, 1 Drawing Sheet

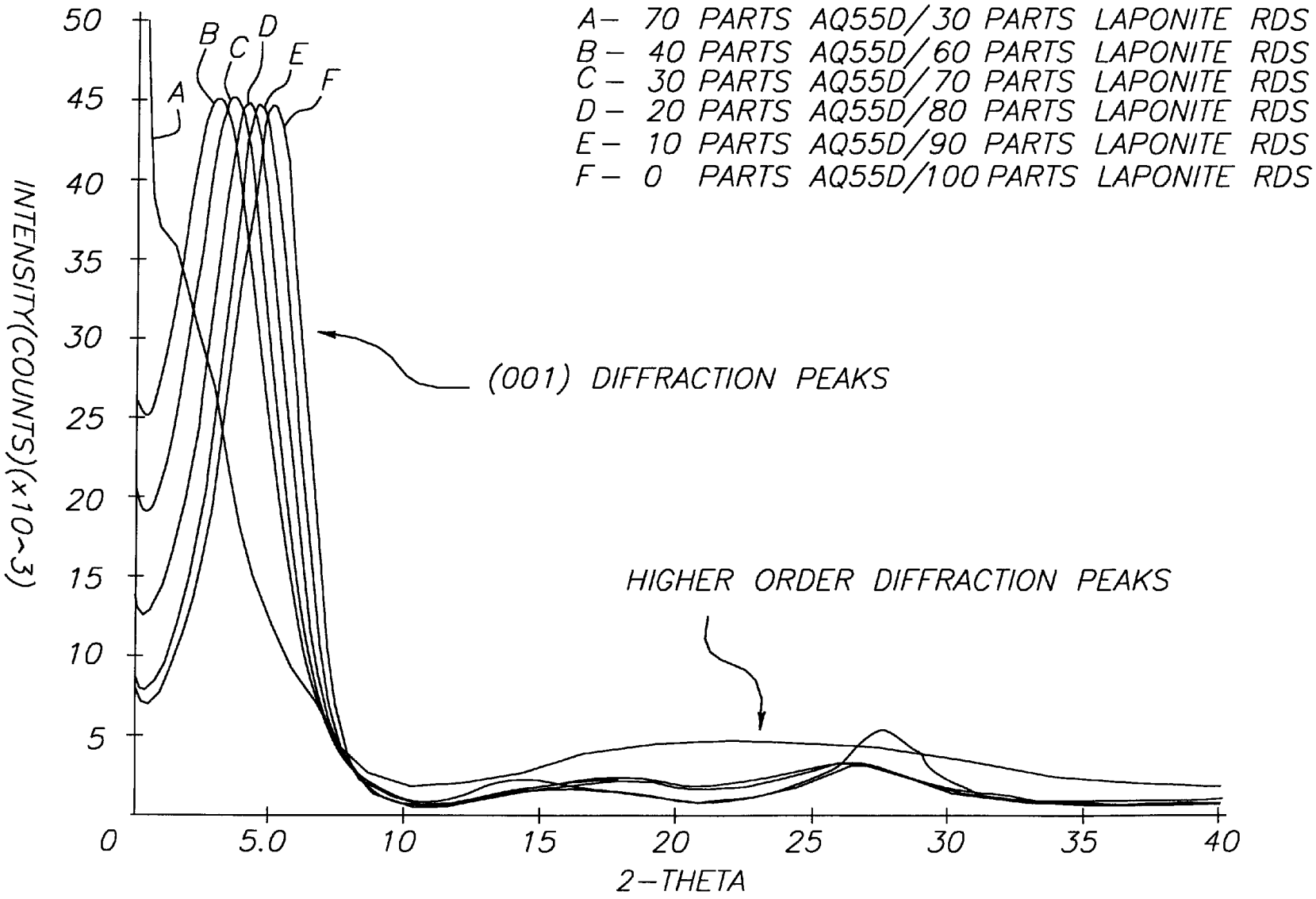
A– 70 PARTS AQ55D/ 30 PARTS LAPONITE RDS
B– 40 PARTS AQ55D/ 60 PARTS LAPONITE RDS
C– 30 PARTS AQ55D/ 70 PARTS LAPONITE RDS
D– 20 PARTS AQ55D/ 80 PARTS LAPONITE RDS
E– 10 PARTS AQ55D/ 90 PARTS LAPONITE RDS
F– 0 PARTS AQ55D/100 PARTS LAPONITE RDS
(001) DIFFRACTION PEAKS
HIGHER ORDER DIFFRACTION PEAKS
A
B
C
D
E
F
INTENSITY(COUNTS)(x10^3)
50
45
40
35
30
25
20
15
10
5
0
5.0
10
15
20
25
30
35
40
2–THETA

CLAY CONTAINING ELECTRICALLY-CONDUCTIVE LAYER FOR IMAGING ELEMENTS

This application relates to commonly assigned copending application Ser. No. 08/937,685, now U.S. Pat. No. 5,891,611 Express Mail No. EM031050112US, filed simultaneously herewith and hereby incorporated by reference for all that it discloses. This application relates to commonly assigned copending application Ser. No. 08/939,515, now U.S. Pat. No. 5,955,190 Express Mail No. EM031050090US, filed simultaneously herewith and hereby incorporated by reference for all that it discloses.

FIELD OF THE INVENTION

This invention relates in general to imaging elements, such as photographic, electrostatographic and thermal imaging elements, and in particular to imaging elements comprising a support, an image-forming layer and an electrically-conductive layer. More specifically, this invention relates to electrically-conductive layers containing conductive clay and to the use of such electrically-conductive layers in imaging elements for such purposes as providing protection against the generation of static electrical charges or serving as an electrode which takes part in an image-forming process.

BACKGROUND OF THE INVENTION

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layer(s) can produce irregular fog patterns or "static marks" in the emulsion. The severity of static problems has been exacerbated greatly by increases in the sensitivity of new emulsions, increases in coating machine speeds, and increases in post-coating drying efficiency. The charge generated during the coating process results primarily from the tendency of webs of high dielectric polymeric film base to charge during winding and unwinding operations (unwinding static), during transport through the coating machines (transport static), and during post-coating operations such as slitting and spooling. Static charge can also be generated during the use of the finished photographic film product. In an automatic camera, the winding of roll film out of and back into the film cassette, especially in a low relative humidity environment, can result in static charging. Similarly, high-speed automated film processing can result in static charge generation. Sheet films are especially subject to static charging during removal irom light-tight packaging (e.g., x-ray films).

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

The requirements for antistatic layers in silver halide photographic films are especially demanding because of the stringent optical requirements, the layers must be both highly transparent and essentially colorless.

Other types of imaging elements such as photographic papers and thermal imaging elements also frequently require the use of an antistatic layer. For these types of imaging elements, the antistatic layer is typically employed as a backing layer. For photographic paper, an additional critical criterion is the ability of the antistatic backing layer to receive printing (e.g., bar codes or other indicia containing useful information) typically administered by dot matrix or inkjet printers and to retain these prints or markings as the paper undergoes processing (viz, backmark retention).

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

Colloidal metal oxide sols which exhibit ionic conductivity when included in antistatic layers are often used in imaging elements. Typically, alkali metal salts or anionic surfactants are used to stabilize these sols. A thin antistatic layer consisting of a gelled network of colloidal metal oxide particles (e.g., silica, antimony pentoxide, alumina, titania, stannic oxide, zirconia) with an optional polymeric binder to improve adhesion to both the support and overlying emulsion layers has been disclosed in EP 250,154. An optional ambifunctional silane or titanate coupling agent can be added to the gelled network to improve adhesion to overlying emulsion layers (e.g., EP 301,827; U.S. Pat. No. 5,204,219) along with an optional alkali metal orthosilicate to minimize loss of conductivity by the gelled network when it is overcoated with gelatin-containing layers (U.S. Pat. No. 5,236,818). Also, it has been pointed out that coatings containing colloidal metal oxides (e.g., antimony pentoxide, alumina, tin oxide, indium oxide) and colloidal silica with an organopolysiloxane binder afford enhanced abrasion resistance as well as provide antistatic function (U.S. Pat. Nos. 4,442,168 and 4,571,365).

Conductive layers employing electronic conductors such as conjugated polymers, conductive carbon fibers, or semiconductive inorganic particles have also been described. Trevoy (U.S. Pat. No. 3,245,833) has taught the preparation of conductive coatings containing semiconductive silver or copper iodide dispersed as particles in an insulating film-forming binder. Such coatings, although they provide excellent conductivities, impart some color to the imaging element and are, therefore, undesirable in many photographic applications.

Conductive fine particles of crystalline metal oxides dispersed with a polymeric binder have been used to form substantially transparent conductive layers for various imaging applications. Many different metal oxides, such as ZnO, $TiO_2$, $ZrO_2$, $SnO_2$, $ZnSb_2O_6$, $Al_2O_3$, BaO, etc, have been described for use in electrically conductive layers as mentioned in U.S. Pat. Nos. 4,275,103, 4,393,441, 4,416,963, 4,418,141, 4,431,764, 4,495,276, 4,571,361, 4,999,276, 5,122,445, and 5,368,995, for example. In order to obtain high electrical conductivity, a relatively large amount of metal oxide must be included in the conductive layer. This results in decreased optical transparency for thick conductive coatings. The high refractive index (>2.0) of the preferred metal oxides necessitates that the metal oxide be dispersed in the form of ultrafine (<0.1 μm) particles, prepared by various mechanical milling processes, in order to minimize light scattering (haze) by the antistatic layer. The cost for these metal oxide materials and the cost involved in the milling process required to obtain ultrafine particle size make the preparation of such conductive layers rather expensive.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are durable and abrasion-resistant, which are effective at low coverage, which are adaptable to use with transparent imaging elements, which are colorless, and which do not exhibit adverse sensitometric or photographic effects.

SUMMARY OF THE INVENTION

In accordance with this invention, an imaging element for use in an image-forming process comprises a support, an image-forming layer, and an electrically-conductive layer; the electrically-conductive layer comprising an electrically-conductive, smectite clay, a first polymeric binder wherein the polymeric binder can sufficiently intercalate inside or exfoliate the smectite clay, and a second polymeric binder which does not sufficiently intercalate inside or exfoliate the smectite clay.

The imaging elements of this invention can contain one or more image-forming layers and one or more electrically-conductive layers and such layers can be coated on any of a very wide variety of supports. The electrically-conductive layers of this invention are adherent, highly transparent and colorless, are manufacturable at reasonable cost, and provide excellent electrical conductivity.

BRIEF DESCRIPTION OF THE DRAWINGS

FIG. 1 shows the x-ray diffraction pattern of clay and polymer in different clay to polymer weight ratios.

For a better understanding of the present invention, together with other objects, advantages and capabilities thereof, reference is made to the following description and claims in connection with the above-described drawing.

DETAILED DESCRIPTION OF THE PREFERRED EMBODIMENTS

The imaging elements of this invention can be of many different types depending on the particular use for which they are intended. Such elements include, for example, photographic, electrostatographic, photothermographic, migration, electrothermographic, dielectric recording and thermal-dye-transfer imaging elements. Imaging elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like.

Details with respect to the composition and function of a wide variety of different imaging elements are provided in U.S. Pat. No. 5,340,676, incorporated herein by reference, and references described therein. The present invention can be effectively employed in conjunction with any of the imaging elements described in the '676 patent.

The present invention encompasses a three component conductive layer which includes component A which is a conducting smectite clay, component B which is one or more polymeric materials capable of sufficiently intercalating inside or exfoliating the conducting smectite clay, and component C which can be one or more film forming polymeric binders which do not intercalate inside or exfoliate the conducting smectite clay. The conductive layer can include a crosslinking agent to further improve the properties of the conductive layer as well as other optional additives.

The clay material (component A) used in this invention is an electrically conducting smectite clay , preferably one closely resembling the natural clay mineral hectorite in both structure and composition. Hectorite is a natural swelling clay which is relatively rare and occurs contaminated with other minerals such as quartz which are difficult and expensive to remove. Synthetic smectite clay is free from natural impurities, prepared under controlled conditions. One such synthetic smectite clay is commercially marketed under the tradename Laponite by Laporte Industries, Ltd of UK through its US subsidiary, Southern Clay Products, Inc. It is a layered hydrous magnesium silicate, in which magnesium ions, partially replaced by suitable monovalent ions such as lithium, sodium, potassium and/or vacancies, are octahedrally coordinated to oxygen and/or hydroxyl ions, some of which may be replaced by fluorine ions, forming the central octahedral sheet; such an octahedral sheet is sandwiched between two tetrahedral sheets of silicon ions, tetrahedrally coordinated to oxygen.

There are many grades of Laponite such as RD, RDS, J, S, etc. each with unique characteristics and can be used for the present invention, as long as they maintain their electrical conductivity. Some of these products contain a polyphosphate peptising agent such as tetrasodium pyrophosphate for rapid dispersion capability; alternatively, a suitable peptiser can be incorporated into Laponite later on for the same purpose. A typical chemical analysis of Laponite RDS and its physical properties, as per Laponite Product Bulletin, are provided below.

TABLE 1

Typical Chemical Analysis

| Component | Weight % |
|---|---|
| $SiO_2$ | 54.5 |
| MgO | 26.0 |
| $Li_2O$ | 0.8 |
| $Na_2O$ | 5.6 |
| $P_2O_5$ | 4.1 |
| Loss on ignition | 8.0 |

TABLE 2

Typical Physical Properties

| | |
|---|---|
| Appearance | White Powder |
| Bulk density | 1000 kg/m$^3$ |
| Surface Area | 330 m$^2$/g |
| pH (2% suspension) | 9.7 |
| Sieve analysis, | 98% < 250 m |
| Moisture content | 10% |

Laponite separates into tiny platelets of lateral dimension of 25–50 nm and a thickness of 1–5 nm in deionized aqueous dispersions, commonly referred to as "sols. " Typical concentration of Laponite in a sol can be 0.1% through 10%. During dispersion in deionized water an electrical double layer forms around the clay platelets resulting in repulsion between them and no structure build up. However, in a formula containing electrolytes introduced from tap water or other ingredients, the double layer can be reduced resulting in attraction between the platelets forming a "House of Cards" structure.

Dispersion of smectite clay (component A) in the polymeric binder (component B) plays a critical role in the performance of the conductive layer. Like any other pigment, the flocculation of the clay phase in the polymeric phase can degrade the mechanical properties of the film. Flocculation of clay can lead to severe dusting and/or post-process reddish discoloration.

The dispersion of clay particles in a polymer matrix can result in the formation of three general types of composite materials as discussed by Lan et al (T. Lan, P. D. Kaviratna and T. J. Pinnavia, Chem. Mater.7, 2144(1995)). (1) Conventional composites may contain clay with the layers unintercalated in a face-to-face aggregation. Here the clay platelet aggregates are simply dispersed with macroscopic segregation. (2) Intercalated clay composites are intercalation compounds of definite structure formed by the insertion of one or more molecular layers of polymer into the clay host galleries. (3) Finally, exfoliated clay-polymer composites where singular clay platelets are dispersed in a continuous polymer matrix. We discovered that the latter two arrangements of the clay in the polymer matrix provides the desired properties of the conductive layers.

Intercalation and exfoliation of clay can be conveniently monitored by measuring the basal (001) spacing of the clay platelets using x-ray diffraction technique, as illustrated by Gianellis et al. in U.S. Pat. No. 5,554,670, incorporated herein by reference. With intercalation of a polymer in the clay gallery, an increase in the basal spacing of the clay is observed. When completely exfoliated, the diffraction peaks disappear since the crystallographic order is lost.

For the current invention the polymeric binder (B) which is capable of sufficiently intercalating inside or exfoliating the clay can be a water soluble polymer (e.g., polyvinyl alcohol, polyethylene oxide, polystyrene sulfonate, polyacrylamide), a hydrophilic colloid (e.g., gelatin) or a water insoluble latex or dispersion (e.g., polymers and interpolymers of styrene, styrene derivatives, alkyl acrylates or alkyl methacrylates and their derivatives, olefins, acrylonitrile, polyurethane and polyester ionomers). The latex polymers are of particular importance because of their widespread use in imaging elements.

X-ray Diffraction Studies of Intercalation Inside or Exfoliation of Smectite Clay The following are examples of intercalation or exfoliation of clay (component A) by various polymeric binders.

Polyesterionomers

The term polyesterionomer refers to polyesters that contain at least one ionic moiety. Such ionic moieties function to make the polymer water dispersible. Examples of this class of polymers include Eastman AQ polyesterionomers manufactured by Eastman Chemical Co. The AQ polymers are well suited for a variety of applications, such as dispersion, adhesion, bonding, coating, priming, etc. These polymers are relatively high molecular weight amorphous polyesters. Upon drying, they form hard clear films adherent to a variety of substrates and resistant to water, blocking and rubbing.

A particular polymer used in this work is Eastman AQ55D with a glass transition temperature of 55° C. The following Table lists the (001) spacing of Laponite RDS clay when mixed with varying amounts of AQ55D. It is clear that the incorporation of increasing amount of AQ55D in the mixture increases the (001) spacing of clay indicating intercalation of the polymer in the clay gallery, leading to eventual exfoliation of clay for a 30/70 clay/binder ratio. The x-ray diffraction patterns are shown in FIG. 1. The shift in the main (001) peak towards lower 2-theta diffraction angles with increasing amount of AQ 55D illustrates the increase in basal plane spacing. This increase in basal plane spacing together with increased peak width, broader and less defined higher order peaks represent intercalation of AQ55D in the clay structure (Curves B through F). Finally, complete loss of intensity of the (001) peaks particularly the higher order peaks for a 30/70 clay/binder ratio indicates exfoliation of the clay in the polymer matrix (Curve A).

| Latex | weight % of Laponite RDS | weight % of latex | Basal plane (001) spacing, Angstroms |
|---|---|---|---|
| | 100 | 0 | 13.4 |
| AQ55D | 90 | 10 | 14.2 |
| AQ55D | 80 | 20 | 15.5 |
| AQ55D | 70 | 30 | 16.9 |
| AQ55D | 60 | 40 | 18.5 |
| AQ55D | 30 | 70 | exfoliation |

Acrylonitriles

Two commercially available acrylonitrile-containing latex polymers were chosen, for this purpose. These are supplied by BF Goodrich as Hycar 1570X75 and Hycar 1572X64. As indicated in the following Table for a 30/70 clay/latex mixture, both the aforementioned latex materials caused exfoliation of the clay.

| Latex | weight % of Laponite RDS | weight % of latex | Basal plane (001) spacing, Angstroms |
|---|---|---|---|
| Hycar 1570X75 | 30 | 70 | exfoliation |
| Hycar 1572X64 | 30 | 70 | exfoliation |

Polyurethanes

Two commercially available aqueous dispersions of anionic aliphatic polyurethanes were chosen for this purpose. One was Witcobond 232 supplied by Witco Corporation. The other was Bayhydrol PR 240 supplied by Bayer. As shown in the following Table, the basal plane spacing of Laponite RDS increased by 6.8 Angstroms or 51 percent when the clay/latex ratio is changed from 100/0 to 30/70 with Bayhydrol PR 240 as the binder. In comparison, the same basal plane spacing of Laponite RDS increased by 3.1 Angstroms or 23 percent when the clay/latex ratio is changed from 100/0 to 30/70 with Witco 232 as the binder. It is obvious that for a 30/70 clay/binder ratio, Bayhydrol PR 240 had more intercalation inside the clay lattice than Witco 232.

| Polyurethane | weight % of Laponite RDS | weight % of latex | Basal plane (001) spacing, Angstroms |
|---|---|---|---|
| Bayhydrol PR240 | 30 | 70 | 20.2 |
| Witco 232 | 30 | 70 | 16.5 |
| | 100 | 0 | 13.4 |

Water Soluble Polymers

Gelatin as a hydrophilic colloid was used as a binder for clay. As shown in the following Table, for a 30/70 clay/binder ratio, gelatin caused exfoliation of the clay.

| Polymer | weight % of Laponite RDS | weight % of colloid | Basal plane (001) spacing, Angstroms |
|---|---|---|---|
| gelatin | 30 | 70 | exfoliation |

A sulfonated polystyrene and a sulfonated styrene/maleic anhydride copolymer, commercially supplied as Versa TL130 and Versa TL3, respectively, by National Starch and Chemical Company were used as binders. As shown in the following Table, for a 30/70 clay/binder ratio, both Versa TL130 and Versa TL3 caused exfoliation of the clay.

| Polymer | weight % of Laponite RDS | weight % of polymer | Basal plane (001) spacing, Angstroms |
|---|---|---|---|
| Versa TL130 | 30 | 70 | exfoliation |
| Versa TL3 | 30 | 70 | exfoliation |

Polymeric binders capable of "sufficiently" intercalating inside the clay are defined to be those which can increase the basal plane spacing of the clay by 50 percent or more, when the clay/binder weight ratio is changed from 100/0 to 30/70.

Polymeric binders (Component C) which do not sufficiently intercalate inside or exfoliate the clay can still be incorporated in a functional conductive layer, through the use of polymeric binder (Component B) which is capable of sufficiently intercalating inside or exfoliating the conducting smectite clay in combination with polymeric binder (Component C). This will allow a formulator to choose from a wider selection of polymeric binders, which although not intercalating inside or exfoliating the conducting smectite clay, provide other attractive properties such as adhesion to various substrates, abrasion and scratch resistance, cost, film-forming properties, thermal properties, and the like. Polymeric binders (Component C) which do not sufficiently intercalate inside or exfoliate the clay are defined to be those which do not increase the basal plane spacing of the clay by 50 percent or more, when the clay/binder weight ratio is changed from 100/0 to 30/70. The polymeric binders chosen as component C may include water soluble polymers, synthetic latex polymers such as acrylics, styrenes, acrylonitriles, vinyl halides, butadienes, and others, or water dispersible condensation polymers such as polyurethanes, polyesters, polyamides, epoxides, and the like.

In the practice of the present invention, the dried conductive layer contains 20 to 80 weight % of component A, 2 to 20 weight % of component B, and 20 to 80 weight % of component C, the total weight % of components A, B, and C being equal to 100%. The relative amounts of components A, B, and C within the above ranges are chosen to meet the specific requirements for the type of imaging element employing the conductive layer or the location of the conductive layer in the imaging element.

U.S. Pat. No. 5,340,676 describes an imaging element comprising an electrically-conductive layer containing a film-forming hydrophilic colloid, water insoluble polymer particles, and electrically-conductive metal-containing particles. Although the '676 patent describes an electrically-conductive layer containing three components, this patent did not describe or suggest the use of conductive smectite clays or the improvements obtained by utilizing a polymeric binder that intercalates inside or exfoliates such clays. The conductive metal-containing particles taught in the '676 patent are incapable of being intercalated or exfoliated by additives such as polymeric binders.

The coating compositions of the present invention are coated at a dried coverage of between 10 mg/m$^2$ and 10000 mg/m$^2$, preferably between 300 and 1000 mg/m$^2$. The layers prepared in accordance with this invention exhibit resistivities less than 12 log ohms/square at 50% relative humidity and preferably from about 9 to 11 log ohms/square.

In addition to components A, B, and C described above, other components that are well known in the photographic art may also be present in the electrically-conductive layer. These additional components include: surfactants and coating aids, thickeners, crosslinking agents or hardeners, soluble and/or solid particle dyes, antifoggants, magnetic particles, matte beads, lubricants, and others.

The coating formulations can be applied to the aforementioned film or paper supports by any of a variety of well-known coating methods. Handcoating techniques include using a coating rod or knife or a doctor blade. Machine coating methods include skim pan/air knife coating, roller coating, gravure coating, spin coating, curtain coating, bead coating or slide coating.

The electrically-conductive layer or layers containing the conductive smectite clay can be applied to the support in various configurations depending upon the requirements of the specific application. In the case of photographic elements for graphics arts application, a conductive layer can be applied to a polyester film base during the support manufacturing process after orientation of the cast resin on top of a polymeric undercoat layer. The conductive layer can be applied as a subbing layer under the sensitized emulsion, can the side of the support opposite the emulsion or on both sides of the support. Alternatively, the conductive layer can be applied as part of a multi-component curl control layer on the side of the support opposite to the sensitized emulsion. The conductive layer would typically be located closest to the support. An intermediate layer, containing primarily binder and antihalation dyes functions as an antihalation layer. The outermost layer containing binder, matte, and surfactants functions as a protective overcoat.

In the case of photographic elements for direct or indirect x-ray applications, the conductive layer can be applied as a subbing layer on either side or both sides of the film support. In one type of photographic element, the conductive subbing layer is applied to only one side of the film support and the sensitized emulsion coated on both sides of the film support. Another type of photographic element contains a sensitized emulsion on only one side of the support and a pelloid containing gelatin on the opposite side of the support. A conductive layer can be applied under the sensitized emulsion or, preferably, the pelloid. Additional optional layers can be present. In another photographic element for x-ray applications, a conductive subbing layer can be applied either under or over a gelatin subbing layer containing an antihalation dye or pigment. Alternatively, both antihalation and electrically conductive functions can be combined in a single layer containing conductive particles, antihalation dye, and a binder. This hybrid layer can be coated on one side of a film support under the sensitized emulsion.

The conductive layer of this invention may also be used as the outermost layer of an imaging element, for example, as the protective overcoat that overlies a photographic emulsion layer. Alternatively, the conductive layer can function as an abrasion-resistant backing layer applied on the side of the film support opposite to the imaging layer.

It is also contemplated that the electrically-conductive layer described herein can be used in imaging elements in which a relatively transparent layer containing magnetic particles dispersed in a binder is included. The electrically-conductive layer of this invention functions well in such a combination and gives excellent photographic results. Transparent magnetic layers are well known and are described, for example, in U.S. Pat. No. 4,990,276, European Pat. 459,349, and Research Disclosure, Item 34390, November, 1992, the disclosures of which are incorporated herein by reference. As disclosed in these publications, the magnetic particles can be of any type available such as ferro- and ferri-magnetic oxides, complex oxides with other metals, ferrites, etc. and can assume known particulate shapes and sizes, may contain dopants, and may exhibit the pH values known in the art. The particles may be shell coated and may be applied over the range typical of dried coating coverages.

In a particularly preferred embodiment, the imaging element of this invention is a photographic element that includes an image-forming layer which is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextrain, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a photographic paper bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the photographic elements of the present invention can contain one or more auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. Details regarding supports and other layers of the photographic elements of this invention are contained in Research Disclosure, Item 38957, September 1996, Research Disclosure, Item 36544, September, 1994 and Research Disclosure, Item 37038, February 1995 incorporated herein by reference.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 38957, September 1996 and Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The current invention is further illustrated through the following examples.

SAMPLE PREPARATION

Either corona-discharge treated polyolefin coated photographic paper or polyester film base that had been previously coated with a subbing layer of vinylidene chloride-methacrylonitrile-acrylic acid terpolymer latex was used as the web on which aqueous coatings were applied through hopper coating. The coatings were dried at 180 to 230° F. The coating coverage was 300 mg/m$^2$ or 600 mg/m$^2$ when dried. The coatings on the photographic paper were evaluated for surface resistivity, backmark retention, splice strength and track off. The coatings on the polyester film base were evaluated for dry adhesion and surface resistivity. In addition, the coatings on the polyester film base were overcoated with a solvent coated layer of polymethylmethacrylate, supplied as Elvacite 2041 by ICI Acrylics. These overcoated samples were evaluated for internal resistivity.

TEST METHODS

Resistivity Tests

Samples are preconditioned at 50% RH 72° F. for at least 24 hours prior to testing. Surface electrical resistivity (SER) is measured with a Keithly Model 616 digital electrometer using a two point DC probe by a method similar to that described in U.S. Pat. No. 2,801,191. Internal resistivity or "water electrode resistivity" (WER) was measured by the procedures described in R. A. Elder, Resistivity Measurements on Buried Conductive Layers", EOS/ESD Symposium Proceedings, September 1990, pages 251–254.

Backmark Retention Test

A printed image was applied onto the coated papers prepared as above using a pre-process ribbon print. The paper was then subjected to a conventional developer for 30 seconds, washed with warm water for 5 seconds and rubbed for print retention evaluation. The following ratings are assigned, with numbers 1–3 indicating acceptable performance.

1=Outstanding, very little difference between processed and unprocessed appearance.
2=Excellent, slight degradation of appearance
3=Acceptable, medium degradation of appearance
4=Unacceptable, serious degradation of appearance
5=Unacceptable, total degradation.

Splice Strength Measurement

The backside of a strip of photographic paper containing the coating of interest is placed with 6–8 mm of overlap on the photographic element containing side of a similar strip of photographic paper and heated in a custom made set up for 4 seconds under 40 psi of pressure, replicating the conditions used by commercially available equipment used for heat splicing of photographic paper. The strength of the resultant splice is determined in an Instron machine as the force (measured in grams) necessary to peel the two strips apart, using a crosshead speed of 50 mm/min. Higher splice strength values represent better performance in this test.

Track Off Test

A loop is formed of a strip of photographic paper containing the coating of interest on its backside and is run for 15 minutes in a custom made set up over a number of rollers, including one with a soft, tacky surface and a stationary shoe, also with a soft, tacky surface. The set up is designed to simulate the conveyance of photographic web in a commercial printer. The surface of the tacky roller and the shoe in contact with the test coating is visually inspected for debris after the run and the number of specs accumulated at the shoe are counted as a measure of track off. The tests are done at 80% RH and 72° F., after preconditioning the sample at the same conditions for 12 hours, in order to maximize the generation of track off debris.

Dry Adhesion Test

Dry adhesion of the coatings to the film base was determined by scribing small hatch marks in the coating with a razor blade, placing a piece of high tack tape over the scribed area and then quickly pulling the tape from the surface. The amount of the scribed area removed is a measure of the dry adhesion.

EXAMPLES

Examples 1 to 3 and Comparative Samples A, B and C

Examples 1 to 3 are prepared with a conductive layer containing Laponite RDS (component A), AQ55 D or Versa TL 3 (component B), and Witcobond 232 (component C). A small amount (15 weight % of component C) of cross linking agent was also added to each sample to further improve the mechanical properties. As described earlier, AQ55D and Versa TL 3 (component B) are compounds capable of sufficiently intercalating inside and/or exfoliating the Laponite RDS(component A). On the other hand Witcobond 232 (Component C) cannot sufficiently intercalate inside and/or exfoliate Laponite RDS. Comparative sample A was prepared with a conductive layer containing Laponite RDS (component A) and AQ55D (component B), no component C was used in the coating. Comparative samples B and C were prepared with a conductive layer containing Laponite RDS (component A) and Witcobond 232 (component C), no component B was used in the coating. The conductive coatings were applied as backing layers on photographic paper and evaluated for SER, backmark retention, splice strength, and trackoff. The details of the coatings and the test results are listed in the following Table.

Clearly, the example conductive coatings satisfy the various criteria desired of photographic paper. The overall results regarding, resistivity, backmark retention, splice strength and track off tests obtained from examples 1 to 3 prepared as per the current invention are better than those obtained from the comparative samples. For example, comparison of sample A, which did not contain component C, with example 2, which had similar coverage and concentration of Laponite clay, shows that the coating of the invention had comparable SER and backmark retention results and superior splice strength and track off results. Samples B and C which did not contain component B had either poor SER values (sample B) or gave an unacceptable reddish coloration upon photographic processing (sample C). This illustrates a key teaching of the present invention, that a three component system which includes two polymeric binders, one which sufficiently intercalates inside and/or exfoliates the smectite clay and one which does not, provides superior overall performance to a two component coating.

| Coating | Comp. A Laponite wt. % | Comp. B wt. % | Comp. C Witco 232 wt. % | coverage mg/m$^2$ | SER log Ω/□ | Backmark retention | splice strength peel force, g | Track off |
|---|---|---|---|---|---|---|---|---|
| Sample A | 60 | 40 (AQ55D) | 0 | 600 | 10.3 | 1 | 130.3 | slight pickoff |
| Sample B | 60 | 0 | 40 | 600 | 11.2 | not tested | not tested | not tested |
| Sample C | 70 | 0 | 30 | 600 | 10.1 | reddish coloration | 207 | not tested |
| Example 1 | 71.4 | 10.7 (AQ55D) | 17.9 | 600 | 9.6 | 2 | 182 | clean |
| Example 2 | 63.3 | 9.5 (AQ55D) | 27.2 | 600 | 10.4 | 1 | 273 | clean |
| Example 3 | 63.3 | 9.5 (Versa TL3) | 27.2 | 300 | 9.4 | 3 | 395 | slight pickoff |

Examples 4 to 12

The following examples were coated as per the teachings of the present invention onto a polyester support. In all these samples, Laponite RDS is chosen as component A and Versa TL 130 as component B. Component C is chosen to be a polyurethane, Witcobond 232 for examples 4 to 7 and Witcobond 236 for examples 8 to 12. All of the example coatings gave excellent dry adhesion results. As indicated in the following tables, all these coatings provided adequate SER values to be used as effective antistatic layers.

| Coating | Component A Laponite RDS | Component B Versa TL 130 | Component C Witcobond 232 | Coverage mg/m$^2$ | SER log ohm/square |
|---|---|---|---|---|---|
| | wt % | wt % | wt % | | |
| Example 4 | 37.7 | 5.7 | 56.6 | 600 | 11 |
| Example 5 | 46.5 | 7 | 46.5 | 600 | 10.1 |
| Example 6 | 55.0 | 8.3 | 36.7 | 600 | 9.1 |
| Example 7 | 71.4 | 10.7 | 17.9 | 600 | 8.2 |
| | dry wt % | dry wt % | dry wt % | | |
| Example 8 | 37.7 | 5.7 | 56.6 | 600 | 11.3 |
| Example 9 | 46.5 | 7 | 46.5 | 600 | 10.6 |
| Example 10 | 55.0 | 8.3 | 36.7 | 600 | 10 |
| Example 11 | 63.3 | 9.5 | 27.2 | 600 | 9.2 |
| Example 12 | 71.4 | 10.7 | 17.9 | 600 | 8.7 |

Examples 13 to 17

In the following examples, coatings were applied as per the teachings of the present invention as antistatic layers onto a polyester support and these were subsequently overcoated with a layer of polymethylmethacrylate, supplied as Elvacite 2041 by ICI Acrylates, which is well known in the imaging and photographic art as an abrasion resistant overcoat. As indicated in the following Table all these samples provided adequate resistivity values (WER) to be used as buried antistatic layers.

| Sample | Composition of buried layer | Coverage of buried layer mg/m$^2$ | SER, before overcoating log ohm/square | Overcoat | Coverage of overcoat mg/m$^2$ | WER, after overcoating log ohm/square |
|---|---|---|---|---|---|---|
| Example 13 | Same as example 6 | 600 | 9.1 | Elvacite 2041 | 900 | 9.3 |
| Example 14 | Same as example 7 | 600 | 8.2 | Elvacite 2041 | 900 | 8.7 |
| Example 15 | Same as example 10 | 600 | 10 | Elvacite 2041 | 900 | 9.9 |
| Example 16 | Same as example 11 | 600 | 9.2 | Elvacite 2041 | 900 | 9.4 |
| Example 17 | Same as example 12 | 600 | 8.7 | Elvacite 2041 | 900 | 8.9 |

The invention has been described in detail with particular reference to certain preferred embodiments thereof, but it will be understood that variations and modifications can be effected within the spirit and scope of the invention.

What is claimed is:

1. An imaging element comprising:

a support;

an image forming layer superposed on the support; and an electrically conducting layer comprising:

a smectite clay;

a first polymeric binder which sufficiently intercalates inside or exfoliates said smectite clay; and a second polymeric binder which does not sufficiently intercalate inside or exfoliate said smectite clay.

2. The imaging element of claim 1, wherein said smectite clay comprises a synthetic hectorite clay.

3. The imaging element of claim 2, wherein said synthetic hectorite clay comprises a layered hydrous magnesium silicate.

4. The imaging element of claim 1, wherein said first polymeric binder is selected from the group consisting of poly vinyl alcohols, poly ethylene oxides, polyacrylamides, polystyrene sulfonates, hydrophilic colloids, polymers of styrene, polymers of styrene derivatives, interpolymers of styrene, interpolymers of styrene derivatives, alkyl acrylates, alkyl methacrylates, derivatives of alkyl acrylates, derivatives of alkyl methacrylates, olefins, acrylonitriles, polyurethanes and polyester ionomers.

5. The imaging element of claim 1, wherein said second polymeric binder is selected from the group consisting water soluble polymers, acrylics, styrenes, acrylonitriles, vinyl halides, butadienes, polyurethanes, polyesters, polyamides, and epoxides.

6. The imaging element of claim 1, wherein said support is selected from the group consisting of cellulose nitrate films, cellulose acetate films, poly(vinyl acetal) films, polystyrene films, poly(ethylene terephthalate) films, poly (ethylene naphthalate) films, polycarbonate films, glass, metals, papers and polymer-coated paper.

7. The imaging element of claim 1, wherein said electrically conducting layer further comprises a crosslinking agent.

8. The imaging element of claim 1, wherein said electrically conducting layer further comprises a surfactant.

9. The imaging element of claim 1, wherein said electrically conductive layer comprises 20 to 80 weight % of the smectite clay, 2 to 20 weight % of the first polymeric binder, and 20 to 80 weight % of the second polymeric binder.

10. The imaging element of claim 1 wherein a basal plane spacing of the smectite clay increases by at least 50 percent when the smectite clay first polymeric binder weight ratio is changed from 100:0 to 30:70.

* * * * *